United States Patent [19]

Bättig

[11] Patent Number: 4,734,010

[45] Date of Patent: Mar. 29, 1988

[54] DAMPING ELEMENT FOR INDEPENDENT TURBOMACHINE BLADES

[75] Inventor: Josef Bättig, Fislisbach, Switzerland

[73] Assignee: BBC Brown, Boveri & Company, Limited, Baden, Switzerland

[21] Appl. No.: 860,827

[22] Filed: May 8, 1986

[30] Foreign Application Priority Data

May 31, 1985 [CH] Switzerland ..... 2309/85

[51] Int. Cl.[4] ..... F01D 5/22

[52] U.S. Cl. ..... 416/196 R; 416/190; 416/500

[58] Field of Search ..... 416/190, 191, 196 R, 416/500, 192, 193 R, 195, 193 A

[56] References Cited

U.S. PATENT DOCUMENTS

| | | | |
|---|---|---|---|
| 1,270,232 | 6/1918 | Steenstrup | 416/190 |
| 1,378,464 | 5/1921 | Junggren | 416/190 |
| 1,469,901 | 10/1923 | Gilson | 416/196 R |
| 2,914,299 | 11/1959 | Mitchell | 416/191 |
| 3,055,634 | 9/1962 | Mitchell | 416/196 R X |
| 3,209,838 | 10/1965 | Frankel | 416/196 R X |
| 3,451,654 | 6/1969 | Johnson | 446/196 R X |
| 3,708,244 | 1/1973 | Dawson et al. | 416/196 R |
| 3,751,182 | 8/1973 | Brown | 416/500 X |

FOREIGN PATENT DOCUMENTS

| | | | |
|---|---|---|---|
| 563458 | 11/1932 | Fed. Rep. of Germany | 416/196 R |
| 2525043 | 1/1976 | Fed. Rep. of Germany | 416/500 |
| 92303 | 7/1981 | Japan | 416/196 R |
| 168007 | 10/1982 | Japan | 416/191 |
| 153004 | 1/1956 | Sweden | 416/196 R |
| 2112466 | 7/1983 | United Kingdom | 416/140 |

*Primary Examiner*—Everette A. Powell, Jr.

*Attorney, Agent, or Firm*—Burns, Doane, Swecker & Mathis

[57] ABSTRACT

The present invention relates to a damping element for independent blades of a turbomachine in which the blades fastened in the rotor are connected together, preferably in the radially outer region, the connection between two blades consists of an elastically deformable platelet curved towards the center of the rotor, which platelet engages in retention features on the suction side of one blade and on the pressure side of a second, neighboring blade. The retention features on the blades can be either recesses or protruding lugs, in or on which the platelets are supported.

5 Claims, 6 Drawing Figures

DAMPING ELEMENT FOR INDEPENDENT TURBOMACHINE BLADES

FIELD OF THE INVENTION

The invention relates to a damping element for the independent blades of a turbomachine in which the blades fastened in the rotor are connected together, preferably in the radially outer region.

BACKGROUND OF THE INVENTION

Independent rotor blades in both axial flow turbines and radial flow compressors or turbines are subject to the danger of vibration. During operation, the individual blades of such turbomachines execute natural vibrations which depend on the type of vibration to which they are subjected, such as tangential bending, axial bending or torsion.

Known methods of vibration damping include connecting together several blades to form a group, fully enclosed fastening by means of shrouds at the blade tips or solid connection elements on the blade airfoils in their radially outer region and, finally, tangential or zig-zag-shaped threading of damping wires or brazing in connecting wires.

Most of the methods become inappropriate if it is necessary to undertake vibration damping measures in the case of the integral turbines of exhaust gas turbochargers which today operate at very high peripheral speeds. Up till now, these one-piece rotors could only be provided with cast-on connecting elements. The latter procedure is, however, extremely difficult, and manufacture is consequently expensive.

SUMMARY AND OBJECTS

The object of the invention is therefore to provide a suitable and easily fitted damping system for all types of independent blades.

This is achieved, according to the invention, in that the connection between two blades consists of an elastically deformable platelet which is curved towards the center of the rotor and is engaged in retention features on the suction side of one blade and on the pressure side of a second neighbouring blade.

The advantage of the new measure, in addition to the extraordinary simplicity, may be particularly seen in the fact that the curved platelet can be designed to be relatively thin, and therefore with little adverse effect on the flow, because the bending stresses are reduced by the lateral support forces. Compared with damping wires (with a substantially larger cross-section) threaded through holes, the weakening of the blade cross-section is substantially smaller when the retention of the platelets takes place in recesses in the blade airfoil.

It is of advantage for the platelets to be preformed with double curvature. On the one hand, this simplifies the geometry of the retention feature in the blades and, on the other, the platelets receive satisfactory guidance both from their supporting bottom surface and from their almost clearance-free top surface. Even in the case of pure two-point contact, they cannot tip out of the retention feature.

It is desirable that the platelets should be designed oval and should have two circular support surfaces on their narrow sides. This type of support permits axial assembly, during which the platelets only have to be very slightly deformed elastically before they engage in the corresponding acceptance features in the blades. In addition, this type of assembly also permits relatively deep recesses in the blade walls.

If the platelets are designed to be substantially triangular and are therefore equipped with three support surfaces (in which case, one of the support surfaces preferably engages on the suction surface of the blades and the two other support surfaces engage on the pressure surface of the blades), a stable position is achieved because there are only three pressure points. If furthermore, viewed in the axial direction of the turbomachine, the support surface on the blade suction side is located between the two support surfaces on the pressure side, the platelet prevents—in the case of twisted blades—the blades from untwisting during operation.

DESCRIPTION OF THE DRAWINGS

Several embodiments of the invention are illustrated schematically in the drawings. In this.

DETAILED DESCRIPTION

Figure 1:
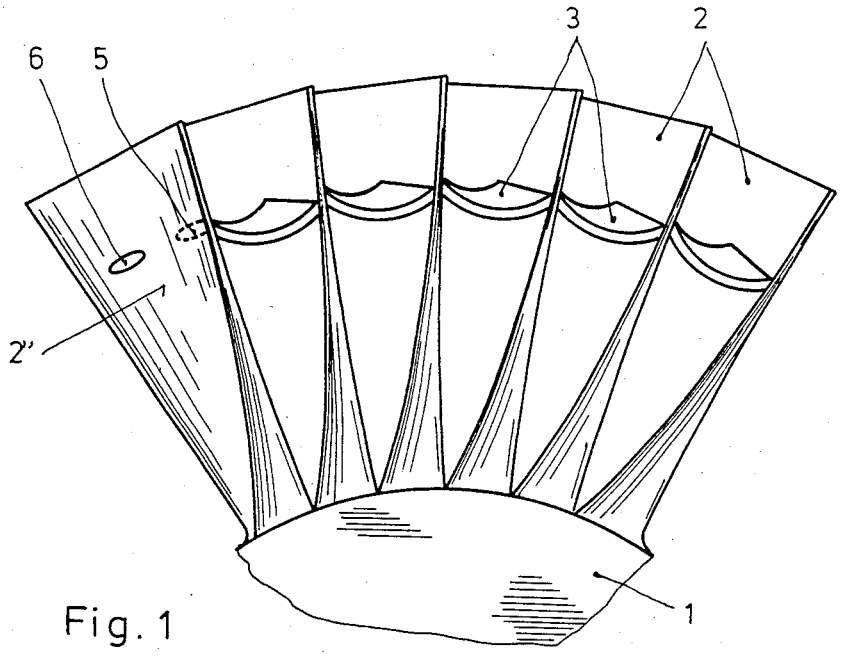
FIG. 1 is a view in the flow direction on a segmental excerpt of a rotor.

Only the elements necessary to understand the invention are shown in the figures, the same elements being provided with the same reference numerals in each case. The blading partially shown in FIG. 1 is that of an exhaust gas turbocharger turbine rotor manufactured in one piece.

Figure 2:
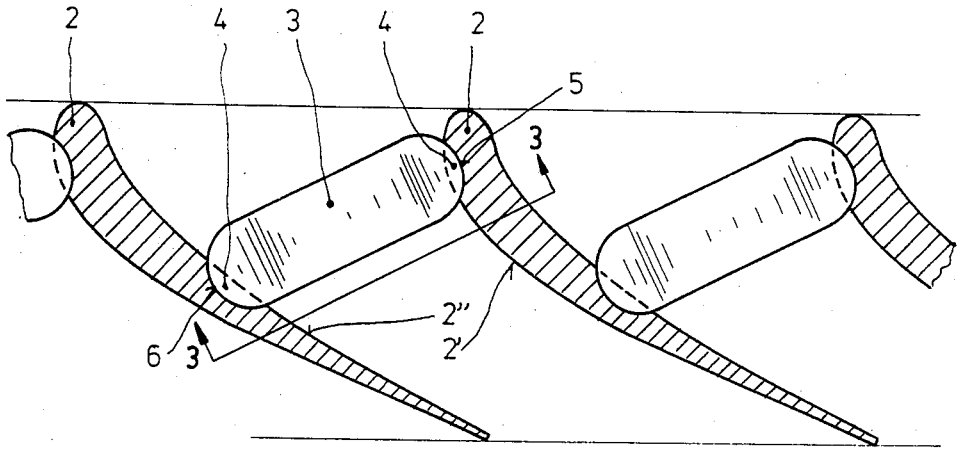
FIG. 2 is a partial cross-sectional view through the blading directly above a first embodiment form of damping elements.

The rotor consists essentially of the turbine disc 1, the twisted rotor blades 2 integrated with it and the damping elements, which are clamped between the blades and are designed as platelets 3. Because of the centrifugal force and temperature conditions present, these platelets are manufactured, such as a nickel-based alloy, such as the material known under the tradename of Nimonic 90, for example. As shown in FIG. 2, the platelets 3 are oval, which should also be understood to include ellipse type shapes or rectangles with their narrow sides rounded. The platelets 3 are located, by means of their semi-circular support surfaces 4 at each end, in correspondingly shaped recesses 5, 6 in the suction side 2' of a first blade, and in the pressure side 2'' of a second neighbouring blade. The recesses can be machined out of the blades 2 or, as in the present case of integral rotors, they can be cast directly with the rotor.

Figure 3:
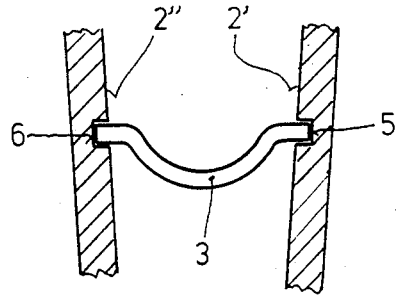
FIG. 3 is a view in cross-section along line 3—3 of FIG. 2, FIGS. 4 and 5 are views in cross-section of alternative preferred embodiments of the present invention.

The platelets, which are preformed during manufacture, have double curvature and are assembled in such a way that the crown of the curvature is directed towards the center of the turbine disc 1 (FIG. 1, FIG. 3).

The assembly of the platelets is undertaken as follows. The platelet is inserted in the axial direction between the inlet profiles of two neighbouring blades, with the support surface brought up against the recess 5 on the suction side 2', and is then pivoted into the recess 6 on the pressure side 2''. The recesses 5 and 6 are completely filled so that there are no cavities on the walls forming the boundaries of the flow.

The necessary support force in operation is obtained, by the assembly prestress and, because of the elastic deformation of the platelet and the blades (torsion). The blades are thus loaded in torsion by this force.

Figure 4:
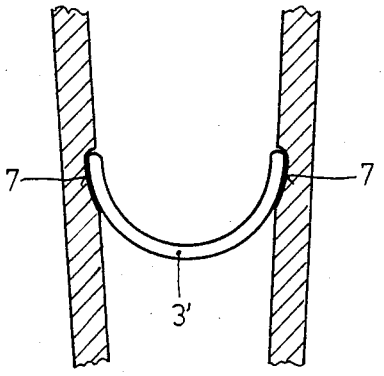
Figure 5:
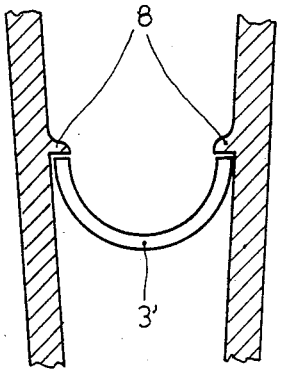

FIGS. 4 and 5 show retention features which are possible when single curvature platelets 3' are used. The retention shown in FIG. 4 takes place in a not very deep recess 7 in the blade airfoils. In FIG. 5, the platelet 3' is supported on the lower surface of a lug 8 cast on the blade airfoil. Both solutions are suitable for assembly in the radial direction, during which the platelets 3' are elastically deformed when being pressed between the blades and then engage in the associated retention feature. Because the platelet curvature points towards the center of the rotor, the centrifugal force during operation has a caulking effect so that the platelet cannot become loose from the particular retention feature.

Figure 6:
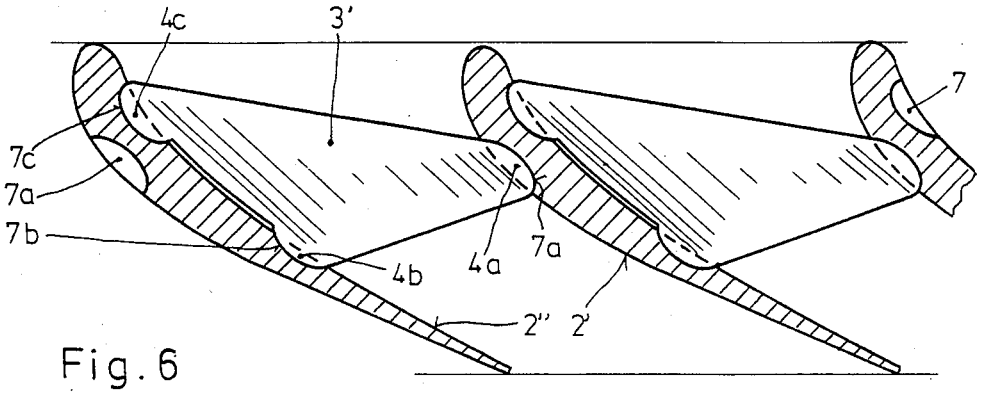
FIG. 6 is a partial cross-sectional view through the blading directly above a second embodiment form of damping elements.

Platelets with single curvature and corresponding retention features can be used with advantage in the variant shown in FIG. 6. In this case, the platelet 3' has a substantially triangular shape with the three support surfaces 4*a*, 4*b* and 4*c*. The support 4*a* is supported on the suction side of the blade in the recess 7*a;* the support surfaces 4*b* and 4*c* are retained in the recesses 7*b* and 7*c* on the pressure side of the neighbouring blade. Seen in the axial direction of the turbomachine, the connection 4*a*/7*a* lies between the two connections 4*b*/7*b* and 4*c*/7*c*, which gives the advantage (already mentioned) that blade torsion is prevented by centrifugal force.

The invention is not, of course, limited to the embodiment examples shown and described. As a variation on the circular connection shown in FIG. 1, each second platelet could, for example, be located on a smaller or a larger radius. The pressure side and suction side recesses on a blade would not then be located in the same radial blade plane and would, therefore, have a less weakening effect on the cross-section.

There is also an application for the new measure in the intake part of centrifugal compressor impellers, where it can be used instead of the expensive zig-zag-shaped damping wires or, where appropriate, the even more expensive shroud connection.

While this invention has been illustrated and described in accordance with preferred embodiments, it is recognized that variations and changes may be made therein without departing from the invention as set forth in the claims.

What is claimed:

1. A turbomachine, comprising:

a plurality of free-standing blades mounted in a rotor, each of said blades having a semicircular recess on the suction side of the blade and a semicircular recess on the pressure side of the blade;

an elastically deformable platelet having a longitudinal axis and a semicircular support at each longitudinal end;

the semicircular supports of said platelet being supported in the semicircular recesses of adjacent blades such that the supports are located in a plane extending substantially perpendicularly to the longitudinal extent of the blades and the longitudinal axis of said platelet extends at an angle to the circumferential direction of the rotor; and said platelet having a double curvature such that when said platelet is mounted between adjacent blades, said platelet curves toward the center of the rotor.

2. The turbomachine of claim 1, wherein the semicircular recess on the suction side of each blade is axially spaced from the semicircular recess on the pressure side of each blade.

3. The turbomachine of claim 1, wherein said platelet is comprised of sheet material and is provided in an oval shape with rounded ends.

4. The turbomachine of claim 1, wherein the supports of said platelet project perpendicularly into the recesses of the adjacent blades.

5. The turbomachine of claim 3, wherein the supports of said platelet are flat and a center portion of the platelet has a convex curve.

* * * * *